United States Patent [19]

Yamada

[11] Patent Number: 4,956,828

[45] Date of Patent: Sep. 11, 1990

[54] WALL CLOCK

[76] Inventor: Hiroshi Yamada, 1-1, Taihei 4-chome, Sumida-ku, Tokyo, Japan

[21] Appl. No.: 359,574

[22] Filed: Jun. 1, 1989

[30] Foreign Application Priority Data

Jun. 1, 1988 [JP] Japan ..... 63-72993[U]

[51] Int. Cl.[5] ..... G04B 19/00; G04B 19/20

[52] U.S. Cl. ..... 368/76; 368/77; 368/233

[58] Field of Search ..... 368/21, 29, 27, 76, 368/80, 77, 223, 228, 233

[56] References Cited

U.S. PATENT DOCUMENTS

| | | | |
|---|---|---|---|
| 1,572,097 | 2/1926 | Walters | 368/77 |
| 2,583,037 | 1/1952 | Alexander | 368/76 |
| 3,464,199 | 9/1969 | Scherz | 368/77 |

FOREIGN PATENT DOCUMENTS

| | | | |
|---|---|---|---|
| 495047 | 3/1930 | Fed. Rep. of Germany | 368/253 |
| 3135859 | 3/1983 | Fed. Rep. of Germany | 368/93 |
| 829701 | 7/1978 | France | 368/233 |

*Primary Examiner*—Vit W. Miska

*Attorney, Agent, or Firm*—Bruce L. Adams; Van C. Wilks

[57] ABSTRACT

An clock has separate rotary dials and separate stationary hands for indicating separate units of time. The dials are rotated at speeds representative of different units of time, such as seconds, minutes and hours, while the hands are maintained stationary. The rotary dials are suspended vertically from one another, and the hands are kept stationary using a counter-balancing weight or the like.

20 Claims, 4 Drawing Sheets

WALL CLOCK

BACKGROUND OF THE INVENTION

This invention relates to a wall clock.

Conventional wall clocks are configured so that a dial is secured in a clock frame hung on a wall or the like and hands mounted in a central portion of the dial rotate to indicate "time".

Although such a wall clock as described above is excellent for indicating "time", its motion is limited as a whole because the hands only rotate, thus it is unfavorable as a display to suit some user's taste since standard wall clocks tend not to be noticeable.

SUMMARY OF THE INVENTION

Therefore, it is an object of the present invention to provide a wall clock which is rich in design and potentially profitable when sold for use as interior furniture.

A first feature of the present invention is that dial for indicating time is mounted so as to rotate in an interlocked relation to the rotational driving of a timepiece movement, with a hand being mounted rotatably in a central portion of the time dial and always pointing upward by virtue of a weight provided in its lower end portion.

A second feature of the present invention is that a second dial and a wheel are coaxially mounted so as to rotate in an interlocked relation to the rotational driving of a timepiece movement, with an hour dial being suspended below the wheel by a belt stretched therearound and rotated in a decelerated manner by means of the belt, with hands being mounted rotatably in respectively central portions of the second and half dials and always pointing upward by virtue of weights provided in their respective lower end portions A third feature is that a second dial and a wheel are coaxially mounted so as to rotate in an interlocked relation to the rotational driving of a timepiece movement, with a minute dial suspended below the wheel by a belt stretched therearound and rotated in an intelocked relation by means of the belt, with an hour dial being suspended below the minute dial by another belt stretched therearound and rotated in a decelerated manner by means of this other belt, and with hands being mounted rotatably in respective central portions of the second, minute and hour dials and always pointing upward by virtue of weights provided in their respective lower end portions.

DESCRIPTION OF PREFERRED EMBODIMENTS

Embodiments of the present invention will now be described in greater detail with reference to the drawings.

Figure 2:
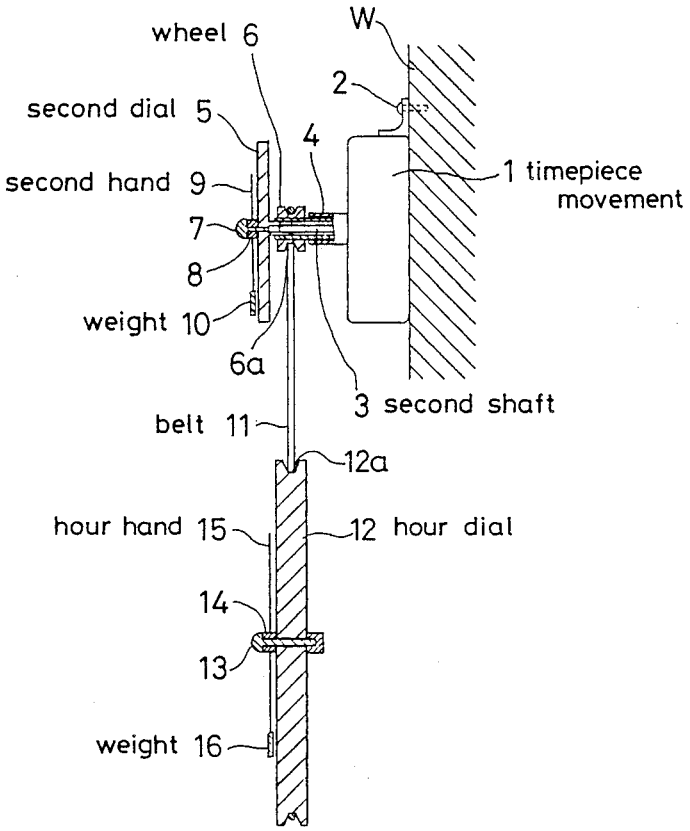
FIG. 2 is a sectional view taken along line A—A of FIG. 1.

In FIG. 2, a timepiece movement 1 is secured on a wall W by a hanging screw 2, in which a second shaft 3 and a minute wheel pipe 4 project in coaxially fitted relation from the timepiece movement 1. A second dial 5 is fixed to the distal end of the second shaft 3, and a minute wheel 6 is fixed to the minute wheel pipe 4.

A pin 7 is press-fitted in the distal end surface of the second shaft 3, and a bushing 8 is fitted rotatably on the pin 7. A second hand 9 having a weight 10 provided at its lower end is fixed to the bushing 8.

Figure 1:
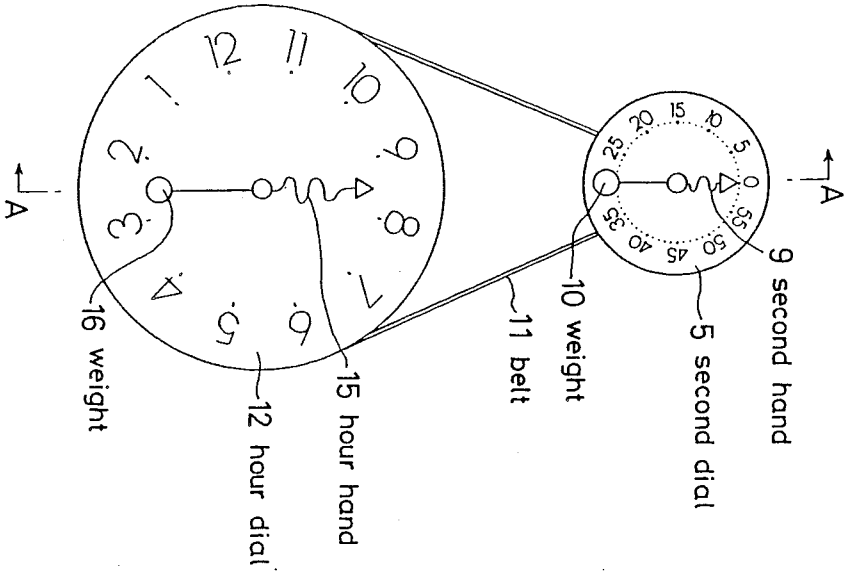
FIG. 1 is a front view.

Therefore, the second hand 9 is rotatable with respect to the second shaft 3 by means of the bushing 8 and always points upward by virtue of the weight 10 as shown in FIG. 1.

The minute wheel 6 fixed to the minute wheel pipe 4 as described above has a groove **6*a* formed in its peripheral surface. A belt 11 engaged in the groove 6*a* of the minute wheel 6 is engaged in a groove 12*a* formed in the peripheral surface of an hour dial 12, so that the hour dial 12 is suspended from the minute wheel 6. The ratio of pitch diameter between the minute wheel 6 and the hour dial 12 is set to 1:12, so that the rotational speed transmitted from the minute wheel 6 to the hour dial 12** is decelerated to one twelfth, with which the latter is rotated.

A pin 13 is fitted in a central portion of the hour dial 12, and an hour hand 15 is fixed to a bushing 14 which is fitted rotatably on the pin 13. A weight 16 is fixed in a lower end portion of the hour hand 15. Therefore, the hour hand 15 always points upward as shown in FIG. 1.

Accordingly, the turning force from the timepiece movement 1 acts via the second shaft 3 to rotate the second dial 5. Thus, one can read "second" on the basis of a second scale of the second dial 5 that is pointed at by the second hand 9 which always faces upward.

Concurrently, the minute wheel 6 is rotated by means of the minute wheel pipe 4, and further, the hour dial 12 is rotated in a decelerated manner by the belt 11 driven by the minute wheel 6. Therefore, one can read "hour" on the basis of a scale of the hour dial 12 pointed at by the hour hand 15 which always faces upward.

In FIG. 1, illustratively, the hour dial 12 and the hour hand 15 in combination indicate 8:30, and the second dial 5 and the second hand 9 in combination indicate 0 second.

Another embodiment will now be described with reference to FIGS. 3 and 4.

A second dial 5 is fixed to the distal end of a second shaft 3 of a timepiece movement 1, and a minute wheel 17 is fixed to a minute wheel pipe 4.

A second hand 9 is mounted on the distal end surface of the second shaft 3 and always points upward by virtue of a weight 10. The foregoing and related configurations are identical with those of the above-mentioned embodiment, whose components are designated by the same reference numerals as those already used.

The minute wheel 17 fixed to the minute wheel pipe 4 as described above has grooves **17*a* and 17*b* formed in front and rear end portions of its peripheral surface, with a small diameter portion being defined between the two grooves. Belts 18*a* and 18*b* engaged in the grooves 17*a* and 17*b* of the minute wheel 17 are engaged in grooves 19*a* and 19*b* formed in both end portions of the peripheral surface of a minute dial 19, so that the minute dial 19 is suspended from the minute wheel 17. As will be appreciated, the minute wheel 17 is identical in diameter with the minute dial 19**.

A pin 20 is fixed in a central portion of the minute dial 19. A minute hand 22 is fixed to a bushing 21 fitted rotatably on the pin 20. Further, a weight 23 is fixed at the lower end of the minute hand 22. Therefore, the minute hand 22 always points upward. Of course, the foregoing configuration is identical with that of the second hand 9.

A small diameter groove 19c is defined between the grooves 19a and 19b of the minute dial 19. A belt 24 engaged in the groove 19c of the minute dial 19 is engaged in a groove 12a formed in the peripheral surface of an hour dial 12, so that the hour dial 12 is suspended from the minute dial 19. The ratio of the pitch diameter between the minute dial 19 and the hour dial 12 is set to 1:12, so that the rotational speed transmitted from the minute dial 19 to the hour dial 12 is decelerated to one twelfth, with which the latter is rotated. A pin 13 is fixed to the hour dial 12, an hour hand 15 is fixed to a bushing 14 fitted rotatably on this pin 13, and the hour hand 15 always points to the upside by virtue of a weight 16. The foregoing configuration is identical with that of the above-mentioned embodiment, whose components are designated by the same reference numerals as those already used.

Therefore, the turning force from the timepiece movement 1 acts via the second shaft 3 to rotate the second dial 5. Thus, one can read "second" on the basis of a second scale of the second dial 5 that is pointed at by the second hand 9 which always faces upward.

Concurrently, the minute wheel 17 is rotated by means of the minute wheel pipe 4, and further, the minute dial 19 is rotated by means of the belts 18a and 18b driven by the minute wheel 17. Therefore, one can read "minute" on the basis of a minute scale of the minute dial 19 that is pointed at by the minute hand 22 which always faces upward.

Further, the hour dial 12 is rotated in a decelerated manner by means of the belt 24 driven by the minute dial 19. Therefore, one can read "hour" on the basis of a scale of the hour dial 12 that is pointed at by the hour hand 15 which always faces upward.

Figure 3:
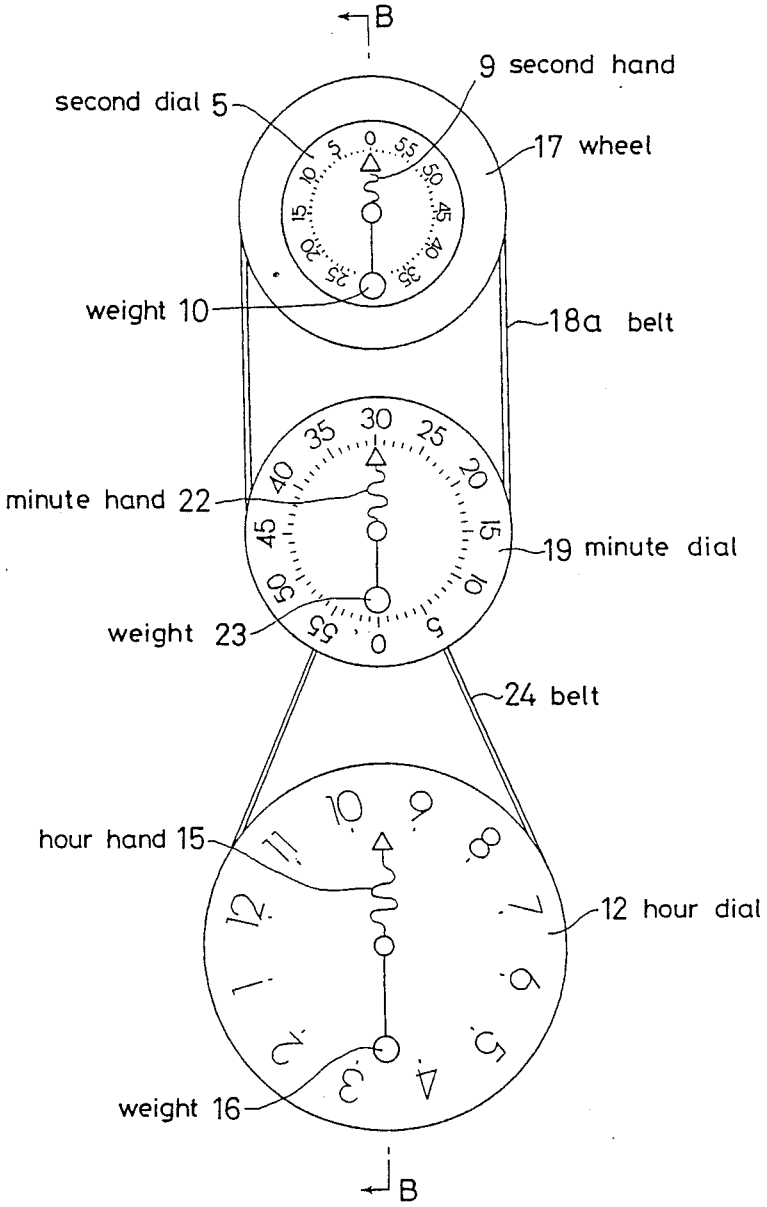
FIG. 3 is a front view showing another embodiment.
Figure 4:
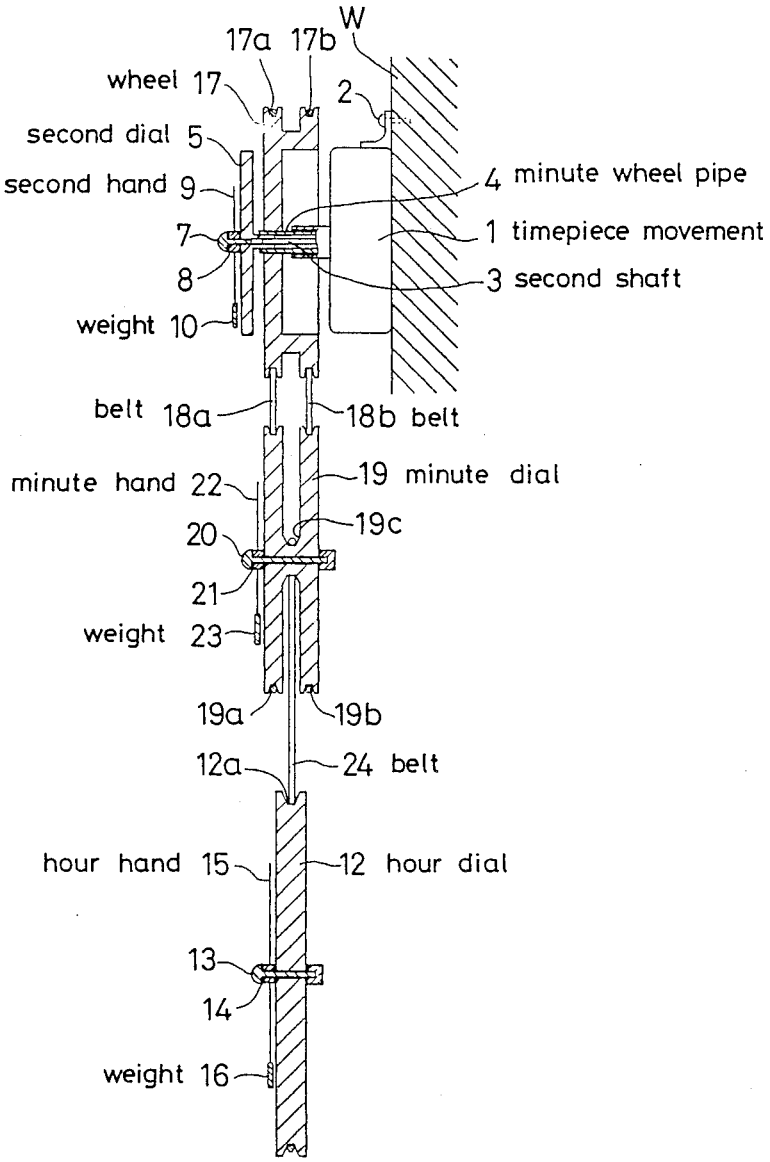
FIG. 4 is a sectional view taken along line B—B of FIG. 3.

In FIG. 3, illustratively, the second dial 5 and the second hand 9 in combination indicate 0 second, the minute dial 19 and the minute hand 22 in combination indicate 30 minutes, and the hour dial 12 and the hour hand 15 in combination indicate around 9:30. That is, the time shown in FIG. 3 is 9:30 and 0 second.

(EFFECTS OF THE INVENTION)

According to the foregoing configuration of the present invention, the time dial, such as the second and minute dials, rotates to present a dynamic expression, whereas the hand indicates "time" in the stationary state wherein it always faces upward, this being opposite to a conventional "clock"; therefore, with the time dial presenting motion as a whole because of its rotation, this novel configuration can attract people's attention. Further, the second dial is positioned above, the minute or hour dial which move at slower rates of rotation more than the second dial; therefore, the overall dynamic expression is emphasized, whereby this novel configuration can attract people's attention from the standpoint of interior furniture.

What is claimed is:

1. A wall clock comprising:

a second dial rotatable in interlocked relation to the rotational driving of a timepiece movement, a wheel mounted coaxially with said second dial and rotatable in interlocked relation to the rotational driving of said timepiece movement, an hour dial suspended below said wheel by a belt stretched therearound and rotated in a decelerated manner by means of said belt, and hands mounted rotatably in respective central portions of said second and hour dials and always pointing upwardly by virtue of weights provided in their respective lower end portions.

2. A wall clock comprising:

a second dial rotatable in interlocked relation to the rotational driving of a timepiece movement, a wheel mounted coaxially with said second dial and rotatable in interlocked relation to the rotational driving of said timepiece movement, a minute dial suspended below said wheel by a belt stretched therearound and rotated in interlocked relation by means of said belt, an hour dial suspended below said minute dial by another belt stretched therearound and rotated in a decelerated manner by means of said another belt, and hands mounted rotatably in respective central portions of said second, minute and hour dials and always pointing upwardly by virtue of weights provided in their respective lower end portions

3. An apparatus for indicating units of time, comprising: a timepiece movement for producing first and second rotary outputs representative of two different units of time; a first rotary dial having on one face thereof indicia representative of first time units; a first time-indicating hand rotatably carried by the first rotary dial and coacting therewith to indicate the first unit of time; means for transmitting the first rotary output of the timepiece movement to the first rotary dial to rotationally drive the first rotary dial at a speed representative of the first time units; a second rotary dial having on one face thereof indicia representative of second time units; a second time-indicating hand rotatably carried out by the second rotary dial and coacting therewith to indicate the second unit of time; and means including an endless belt for transmitting the second rotary output of the timepiece movement to the second rotary dial to rotationally drive the second rotary dial at a speed representative of the second time units.

4. An apparatus according to claim 3; including means for maintaining the first time-indicating hand in a stationary upright position.

5. An apparatus according to claim 4; wherein the means for maintaining comprises a weighted lower end portion of the first time-idicating hand.

6. An apparatus according to claim 4; including means for maintaining the second time-indicating hand in a stationary upright position.

7. An apparatus according to claim 6; wherein the means for maintaining comprises a weighted lower end portion of the second time-indicating hand.

8. An apparatus according to claim 3; including means for maintaining the second time-indicating hand in a stationary upright position.

9. An apparatus according to claim 7; wherein the means for maintaining comprises a weighted lower end portion of the second time-indicating hand.

10. An apparatus according to claim 3; wherein the timepiece movement includes means for producing rotary outputs representative of second and minute time units; the means for transmitting the first output of the timepiece movement comprises means for rotationally driving the first rotary dial at a speed representative of second time units; and the means for transmitting the second rotary output of the timepiece movement comprises means for rotationally driving the second rotary dial at a speed representative of hour time units.

11. An apparatus according to claim 3; wherein the first and second rotary dials are vertically spaced from one another.

12. An apparatus according to claim 11; wherein the endless belt extends in the space between the vertically spaced first and second rotary dials.

13. An apparatus according to claim 3; further including a third rotary dial having on one face thereof indicia representative of third time units; a third time-indicating hand rotatably carried by the third rotary dial and coacting therewith to indicate the third unit of time; and means including another endless belt for transmitting the rotary movement of the second rotary dial to the third rotary dial to rotationally drive the third rotary dial at a speed representative of the third time units.

14. An apparatus according to claim 13; wherein the timepiece movement includes means for producing rotary outputs representative of second and minute time units; the means for transmitting the first rotary output of the timepiece movement comprises means for for rotationally driving the first rotary dial at a speed representative of second time units; the means for transmitting the second rotary output of the timepiece movement comprises means for rotationally driving the second rotary dial at a speed representative of minute time units; and the means for transmitting the rotary movement of the second rotary dial comprises means for rotationally driving the third rotary dial at a speed representative of hour time units.

15. An apparatus according to the claim 14, including means for maintaining the first, second and third time-indicating hands in stationary upright positions.

16. An apparatus according to claim 15, wherein the means for maintaining comprises weighted lower end portions of the first, second and third time-indicating hands.

17. An apparatus according to claim 14; wherein the first, second and third rotary dials are vertically spaced from one another.

18. An apparatus according to claim 13; including means for maintaining the first, second and third time-indicating hands in stationary upright positions.

19. An apparatus according to claim 18; wherein the means for maintaining comprises weighted lower end portions of the first, second and third time-indicating hands.

20. An apparatus according to claim 13; wherein the first, second and third rotary dials are vertically spaced from one another.

* * * * *